US006783430B1

(12) United States Patent
Tawara

(10) Patent No.: US 6,783,430 B1
(45) Date of Patent: Aug. 31, 2004

(54) GRINDING APPARATUS USING FLUID SERVOMOTOR

(75) Inventor: Satoshi Tawara, Takasago (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 544 days.

(21) Appl. No.: 09/642,927

(22) Filed: Aug. 22, 2000

Related U.S. Application Data

(63) Continuation-in-part of application No. 09/144,993, filed on Sep. 1, 1998, now abandoned.

(30) Foreign Application Priority Data

Sep. 1, 1997 (JP) ..... 9-251267

(51) Int. Cl.[7] ..... B24B 27/08
(52) U.S. Cl. ..... 451/8; 451/344
(58) Field of Search ..... 451/344, 295, 451/1, 5, 10, 8

(56) References Cited

U.S. PATENT DOCUMENTS

| | | | | | |
|---|---|---|---|---|---|
| 3,731,433 | A | * | 5/1973 | Clarke et al. | 451/157 |
| 4,258,834 | A | | 3/1981 | Hawley et al. | 191/12.2 R |
| 4,473,971 | A | * | 10/1984 | Mischler et al. | 451/24 |
| 4,527,054 | A | | 7/1985 | White | 250/227 |
| 4,593,555 | A | | 6/1986 | Krutz et al. | 73/116 |
| 4,611,549 | A | | 9/1986 | Kodera et al. | 114/144 E |
| 4,644,749 | A | | 2/1987 | Somes | 60/459 |
| 4,794,736 | A | * | 1/1989 | Fuwa et al. | 451/6 |
| 4,807,501 | A | * | 2/1989 | Leigh et al. | 82/148 |
| 5,018,351 | A | | 5/1991 | Otte | 60/448 |
| 5,597,348 | A | * | 1/1997 | Hutchins | 451/450 |
| 5,598,794 | A | | 2/1997 | Harms et al. | 111/177 |
| 6,085,520 | A | * | 7/2000 | Kohno | 60/414 |

FOREIGN PATENT DOCUMENTS

| | | |
|---|---|---|
| EP | 0 417 283 | 3/1991 |
| EP | 0 426 443 | 5/1991 |
| EP | 0 791 771 | 8/1997 |
| JP | 5-24445 | 2/1993 |

* cited by examiner

*Primary Examiner*—Lee D. Wilson
(74) *Attorney, Agent, or Firm*—Crowell & Moring LLP

(57) ABSTRACT

A grinding apparatus with a grinding wheel on the output shaft of a fluid servomotor driven by fluid from a fluid source and controlled by a servo valve. The servomotor housing is mounted on a stage moveable toward a work to press the grinding wheel against the work. The output shaft extends through a cover. A rotational speed detector includes a rotating member disposed on the output shaft inside the cover and a rotation detecting member attached to the cover facing the rotating member. Differences between the detected rotational speed of the shaft and a target rotational speed are determined by a control device, and the stage is moved in response to signals from the control device, so grinding can be adapted to various conditions. To increase grinding efficiency of the grinding wheel, the target rotation speed is set at the maximum output speed range and the grinding wheel is pressed with increased force against the work, or to prevent wear of the grinding wheel, the target rotation speed is set at the high speed range and the grinding wheel is pressed with decreased force against the work.

5 Claims, 7 Drawing Sheets

GRINDING APPARATUS USING FLUID SERVOMOTOR

CROSS REFERENCE TO RELATED APPLICATION

This application is a continuation-in-part of application Ser. No. 09/144,993, filed Sep. 1, 1998 now abandoned.

FIELD OF THE INVENTION

The present invention relates to a grinding apparatus using a fluid servomotor such as pneumatic or oil hydraulic servomotor which is supplied with pressurized fluid controlled of its flow rate by means of a servo valve as driving fluid.

BACKGROUND OF THE INVENTION

A fluid servomotor device which controls the rotation speed of the load such as grinding wheel, etc. using a fluid motor, was well known in the art. FIG. 7 is a block diagram showing an example of a fluid servomotor of prior art.

In FIG.7, reference numeral 34 is a fluid motor driven by fluid supplied from a fluid source 32 via a servo valve 33, reference numeral 36 is a grinding wheel driven by the fluid motor 34.

The fluid motor 34 is connected to the fluid source 32 via the servo valve 33. The rotational speed of the fluid motor 34 is controlled by the signal inputted to the servo valve 33.

The rotation of the output shaft of the fluid motor 34 is transmitted through gears 37 to a tachogenerator 35, a rotational speed detector. The tachogenerator 35 outputs a voltage proportional to the rotation speed of the fluid motor 34. Reference numeral 31 is a control device, which determines the signal to control the servo valve 33 by calculation based on the voltage signal from tachogenerator 35 and a prescribed rotation speed 30, and output the determined signal.

Through this series of operations, the control of the rotational speed of the grinding wheel 36 connected to the fluid motor 34 is realized. Thus, the fluid motor 34 functions as a servomotor.

In the servomotor device of the prior art, the servomotor 34 and the tachogenerator 35 which is a rotational speed detector, are constructed as separate entities. So, in the case the device is used as a servomotor, a means for transmitting rotation to the rotational speed detector (tachogenerator) 35 must be provided outside the servomotor 34 to detect the rotational speed. Therefore, in the case of, for example, controlling the output of a fluid motor 34 of cylinder diameter of about 30 mm, a rotational speed detector (tachogenerator) 35 of about the same size as the fluid motor 34 is necessary. Thus the configuration of the device becomes large and its downsizing is difficult.

There are also problems in the device of prior art that the rigidity of the control mechanism is lowered by the influence of the backlash in the rotation transmitting mechanism such as gear, timing belt, chain, etc., which causes oscillation.

These problems are important in the case a grinding apparatus is composed by attaching a grinding wheel to the output shaft of a fluid motor.

In the case a fluid motor is used as the driving source of a grinding wheel, a grinding apparatus which needs no consideration for explosion proof and short circuit of electric wiring due to grinding lubricant, etc., which consideration is needed in the case with an electric motor, is possible to be provided, but the rotation speed and output can not be controlled freely by the control of voltage and current as in the case with an electric motor, and so a contrivance is necessary.

SUMMARY OF THE INVENTION

An object of the present invention is, for solving the problems mentioned above, to provide, in the case a grinding apparatus is composed by attaching a grinding wheel to the output shaft of a fluid servomotor, a grinding apparatus which enables grinding with good efficiency concerning the grinding wheel, with a rotational speed detecting means integrated into the motor.

Another object of the present invention is to provide a grinding apparatus which is able to be freely set to a rotation control range whereby grinding is performed with good efficiency concerning the grinding wheel, or to a range whereby the wear of the grinding wheel is prevented.

To solve the problems, the present invention provide a grinding apparatus, in which a grinding wheel is attached to the output shaft of a fluid servomotor having a fluid motor driven by the fluid supplied from a fluid source and controlled through a servo valve, and the motor housing of the servomotor is mounted on a stage capable of being moved in the direction of pressing the servomotor against the work to be ground, characterized in that;

the output shaft of the servomotor is extended through a cover attached to the output side of the fluid motor along the center line of the cover;

a rotating member forming a part of a rotation detector is fit on the output shaft inside the cover, and a rotation detecting member is attached to the cover inside the same facing the rotating member; and the difference between the rotational speed of the output detected by the detecting member and the aimed rotation speed is determined by a control device, and the stage is able to be moved based on the output control signal from the control device.

According to the present invention, as the rotational speed detecting means is provided inside the cover joined to the motor housing so as to make it integral part of the fluid servomotor, the integral unit can be mounted on the stage as it is. So, the grinding apparatus is largely downsized and spatial limitation when the fluid motor is mounted on the stage is eliminated. This increases the freedom of design of fluid motor and a smaller sized, larger output fluid servomotor device compared to that of prior art can be obtained, which is particularly effective for a large grinding apparatus in which fluctuation of the grinding wheel is large.

Further, as the rotating member of the rotation speed detecting means is attached directly to the output shaft of the fluid motor, the occurrence of backlash in the rotation transmitting means of a servomotor of prior art is excluded. As a result, chattering on the side of the grinding wheel, lowering of working rigidity, oscillation, etc., are avoided and grinding performance increases.

As the rotation speed detecting means is provided inside the cover, the danger of malfunction of the detecting means due to grinding powder or grinding lubricant acting as noise is excluded, and the detection of the rotational speed is possible with good accuracy.

Still further, it is suitable to compose so that, for increasing the grinding efficiency of the grinding wheel attached to the output shaft, the aimed rotation speed is set at the speed range of maximum output and grinding is performed with increased pressing force of the grinding wheel against the work to be ground, or to compose so that, for preventing the wear of the grinding wheel attached to the output shaft, the aimed rotation speed is set at the high speed range and grinding is performed with decreased pressing force of the grinding wheel against the work to be ground. Thus, grinding is possible in accordance with various grinding conditions.

It is suitable, for attaining the object of the present invention nicely, that the rotating member attached to the output shaft inside the cover is the rotor of a tachogenerator, or the disk plate of an optical rotary encoder, or the magnetic ring of a magnetic rotary encoder, and the rotation speed detecting member attached to the cover inside the same is the magnetic body of the tachogenerator, or the photointerrupter of the optical rotary encoder, or the hall IC of the magnetic rotary encoder.

DETAILED DESCRIPTION OF THE PREFERRED EMBODIMENTS

Preferred embodiments of the present invention will now be detailed with reference with the accompanying drawings. It is intended, However, that unless particularly specified, dimensions, materials, shapes, relative positions and so forth of the constituent parts described in the embodiments shall be interpreted as illustrative only not as limitative of the scope of the present invention.

Figure 1:
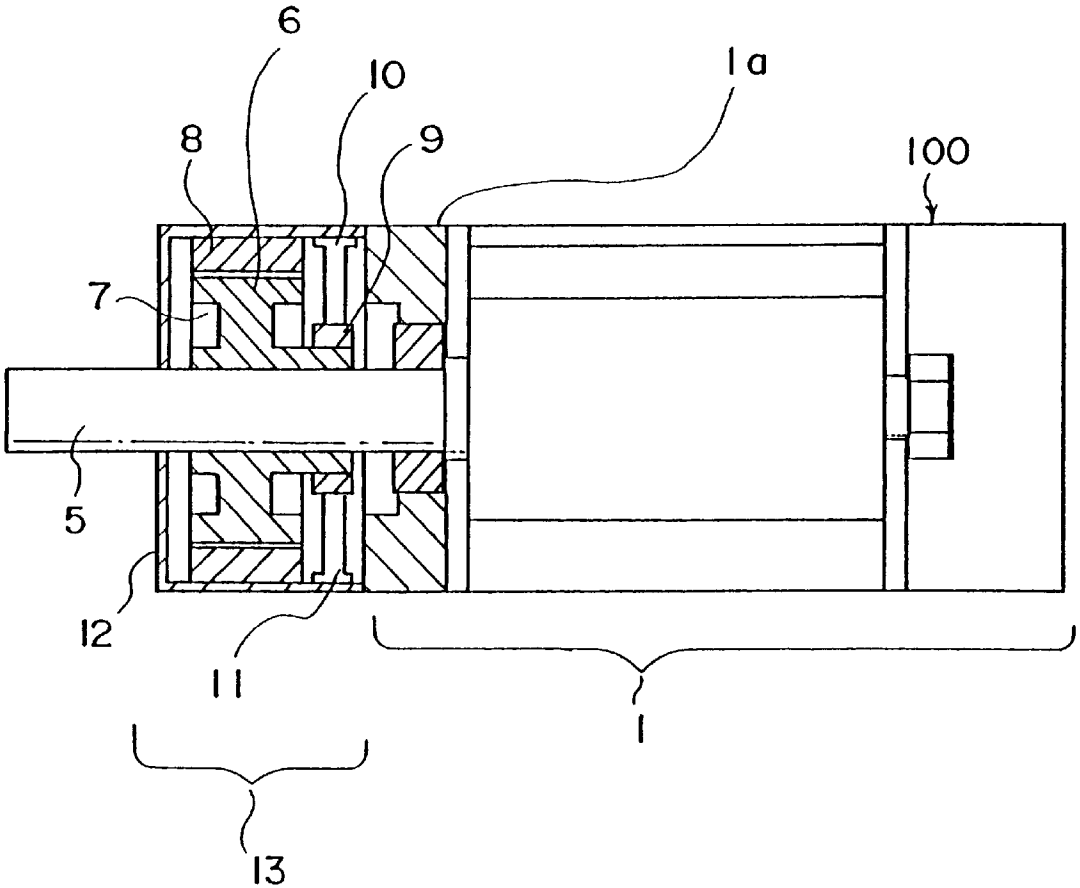
FIG.1 is a fluid motor assembly used in the grinding apparatus according to the present invention, shown with local section.
Figure 2:
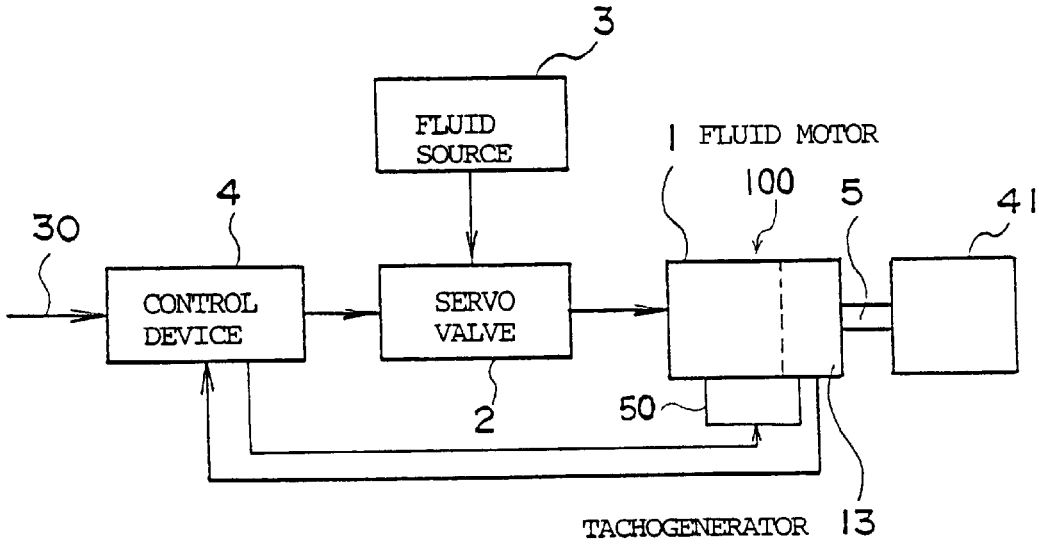
FIG. 2 is a block diagram showing the principal part of a grinding apparatus in which a grinding wheel is attached to the output shaft of the fluid motor.
Figure 3:
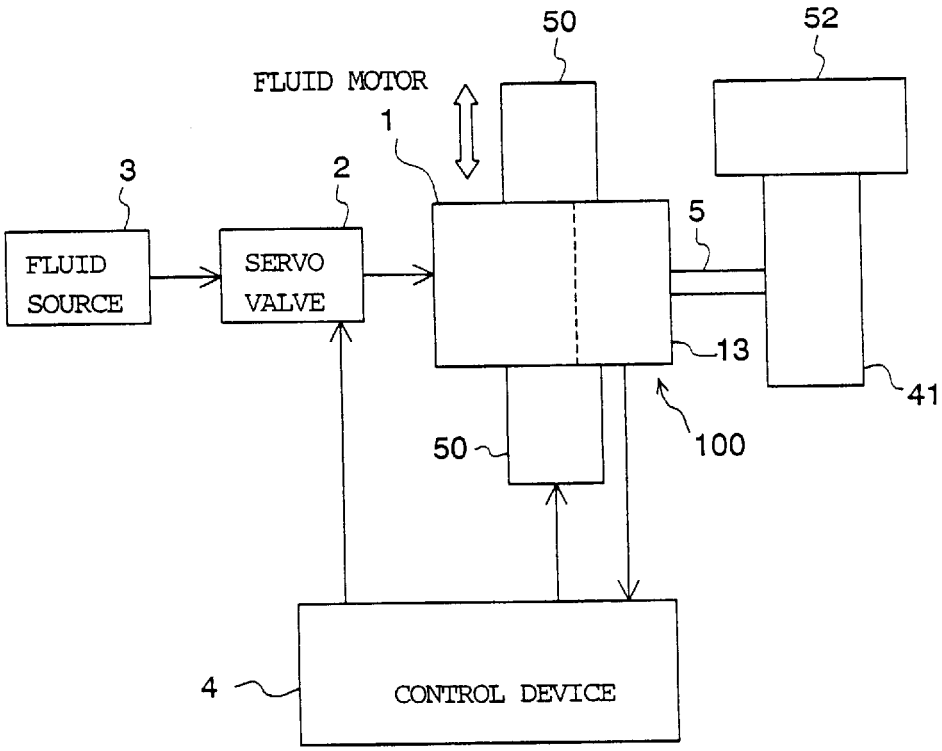
FIG. 3 is a block diagram showing an overall configuration of the grinding apparatus of FIG. 2.
Figure 4:
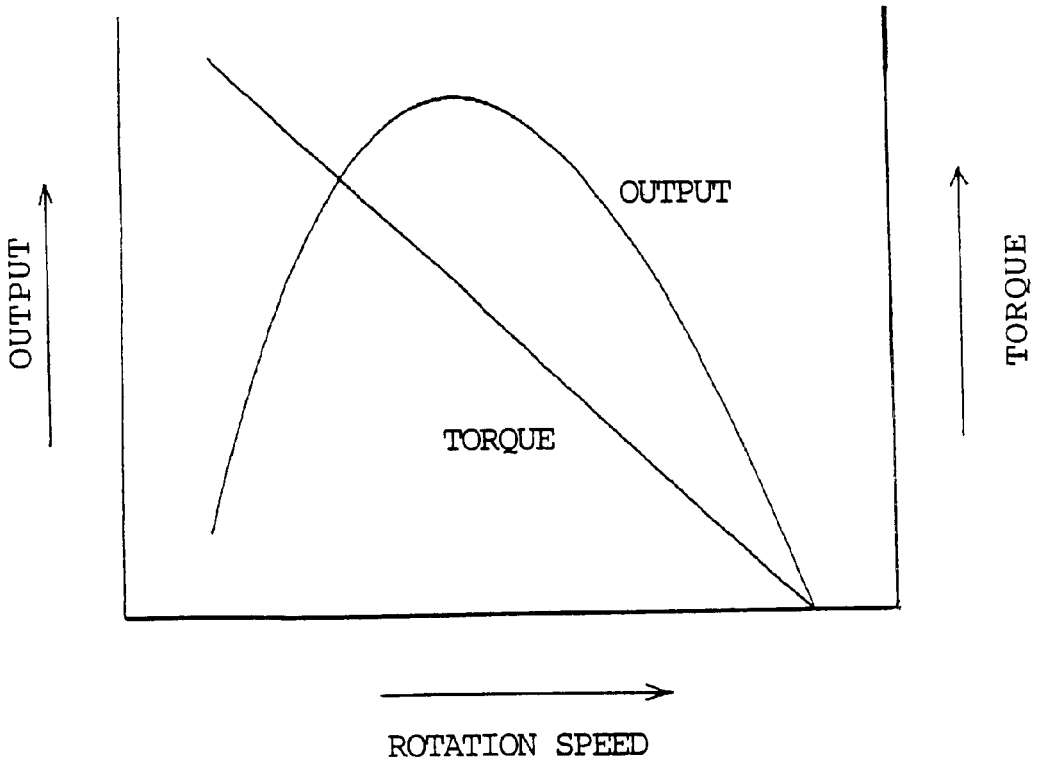
FIG. 4 is a graph showing the relation between the output and rotation speed of the fluid servomotor used in the present invention.

FIG. 1 is a fluid motor device used in the grinding apparatus according to the present invention, shown with local section, FIG. 2 is a block diagram showing the principal part of a grinding apparatus in which a grinding wheel is attached to the output shaft of the fluid motor, FIG. 3 is a block diagram showing a overall configuration of the grinding apparatus of FIG. 2, and FIG. 4 is a graph showing the relation between the output and rotation speed of the fluid servomotor used in the present invention.

At the outset, a fluid servomotor device 100 which is to be mounted on the grinding apparatus will be explained.

In FIG. 2, reference numeral 1 is a fluid motor, reference numeral 2 is a servo valve, reference numeral 4 is a control device, and reference numeral 41 is a grinding wheel attached to the output shaft of the fluid motor 1. The fluid motor 1 is connected to a fluid source 3 via the servo valve 2. The rotational speed of the output shaft 5 of the fluid motor 1 is controlled through controlling the openings of the servo valve 2 based on the control signal inputted to the same.

The rotation of the output shaft 5 of the fluid motor 1 is transmitted directly to a tachogenerator 13. The tachogenerator 13 outputs a voltage proportional to the rotational speed of the fluid motor 1. The control device 4 determines a signal to control the servo valve 2 based on the voltage signal outputted from the tachogenerator 13 in accordance with the rotational speed and an aimed rotation speed 30, and outputs the signal.

Through this series of operations, the grinding wheel 41 connected to the fluid motor 1 is controlled to a aimed rotational speed. Thus, the fluid motor 1 functions as a servomotor.

The fluid motor device 100 is, as shown in FIG. 1, of an integrate construction of the fluid motor 1 and the tachogenerator 13 by way of the output shaft 5.

The rotor 6 of the tachogenerator 13 is fixed on the perimeter of the output shaft 5 extended from the fluid motor 1. The rotor 6 is provided with coils 7 composed of insulation coated wire and both ends of each coil 7 are connected separately to each commutator 9 which is attached with insulation to the rotor 6 and electrically insulated to each other.

Reference number 12 is a cover joined to the housing 1*a* of the fluid motor 1 with bolts (not shown in the drawings). On the internal cylindrical surface of the cover 12 is fixed a ring-shaped magnetic body 8 facing the periphery of the rotor 6. Reference numerals 10 and 11 are brushes.

In operation of the fluid motor device 100, when the fluid motor 1 is driven by the working fluid supplied from the fluid source 3 by way of the servo valve 2, as shown in FIG. 2, the output shaft 5 rotates, accordingly the rotor 6 of the tachogenerator 13 fixed to the same rotates.

A static magnetic field with lines of magnetic force passing in radial planes of the output shaft 5, is generated by the magnetic body 8. So electromotive force is induced in the coils 7 and voltage is generated between the both ends of each coil 7 by the rotation of the coils 7 fixed to the rotor 6 in the static magnetic field.

As the direction of the electromotive force generated in each coil 7 changes according to the relative position of each coil 7 to the static magnetic field, the voltage generated in the coils are rectified through the commutators 9 and brushes 10, 11. A voltage proportional to the rotational speed of the rotating shaft that is the output shaft 5, is taken out from the brushes 10 and 11. The output signal is transmitted to the control device 4 shown in FIG. 2 as a detected signal of the rotational speed of the fluid motor 1.

In the embodiment, the tachogenerator 13 is assembled directly to the output shaft 5 and housing 1*a* of the fluid motor 1 to compose the fluid motor device 100, an integral unit of the fluid motor 1 and tachogenerator 13. So, the unit can be designed smaller in size, spatial limitation when the fluid motor 1 is mounted is eliminated, and design freedom of the fluid motor assembly 100 is increased.

Thus, it is possible to compose a smaller, higher output servomotor device compared to the servomotor of prior art.

Further, as the rotating member (rotor 6) of the tachogenerator 13 is attached directly to the output shaft 5 of the fluid motor 1, the lowering of the rigidity of the control mechanism and occurrence of oscillation, etc. by the influence of the backlash in the rotation transmit means of prior art, is prevented and the increase in performance can be attained.

FIG. 3 is a block diagram showing the overall configuration of the grinding apparatus of FIG. 2, and FIG. 4 is a graph showing the relation of the output and rotation speed of the fluid servomotor used in the present invention.

In FIG. 3, the fluid servomotor device 100 with a grinding wheel attached to its output shaft, is an integral unit of the fluid motor 1 and the tachogenerator 13. The fluid motor device 100 is mounted on a grinder stage 50 which can be moved toward the work to be ground 52. The pressing force of the grinding wheel 41 against the work 52 by moving the stage 50 is controlled by the control signal from the control device 4.

The pressurized fluid such as pressurized air, etc. supplied from the fluid source 3 is introduced to the fluid motor 1 to rotate the grinding wheel 41 attached to the output shaft 5; the grinding wheel 41 is pressed to the work 52 by shifting the stage 50 toward the same; and thus the work 52 is ground.

The fluid motor 1 driven by the pressurized air supplied from the fluid source 3 has generally the output torque characteristics as shown in FIG. 4. It is understand from the figure that the maximum output is obtained at about the middle of the maximum rotation speed. Therefore, an efficient grinding is possible with the rotation speed kept near that of the maximum output and with increased pressing force of the grinding wheel 41 against the work 52 through increased shift of the stage 50 in accordance with the control signal from the control device 4, whereby the grinding time is saved.

Also, an economical and high accuracy grinding is possible with the rotation speed kept in the high rotation range and with decreased pressing force of the grinding wheel against the work through decreased shift of the stage 50, whereby the grinding torque is decreased. In this case, the grinding wheel 41 is kept rotating with high rotation speed and the wear of the grinding wheel is decreased compared to the quantity removed from the work 52 by grinding, so expensive grinding wheel is saved and grinding accuracy is promoted.

According to the characteristics of the fluid motor 1 shown in FIG. 4, with increasing pressing force of the grinding wheel 41 driven by the fluid motor 1 against the work 52, the rotational speed of the fluid motor 1 decreases, and vice versa.

The rotational speed of the fluid motor 1 is detected by a rotation detecting means such as the tachogenerator 13. The difference between the aimed rotational speed which is appropriate to a certain pressing force and the detected rotational speed, is determined by the control device 4. The stage 50 is shifted in accordance with the control signal determined by the control device 4 based on the said difference to apply the pressing force appropriate to the aimed rotational speed. By this control action, when an aimed rotational speed is set at the maximum output range and the pressing force of the grinding wheel 41 against the work 52 is increased, efficient grinding is performed. When an aimed rotational speed is set at the maximum speed range and the pressing force against the work 52 is decreased, grinding with small wear of the grinding wheel 41 is performed.

Although pressurized air is used as working fluid of the fluid servomotor device 100 in the embodiment, not only gas but also liquid such as lubricating oil or other pressurized fluid may be used as working fluid.

Figure 5:
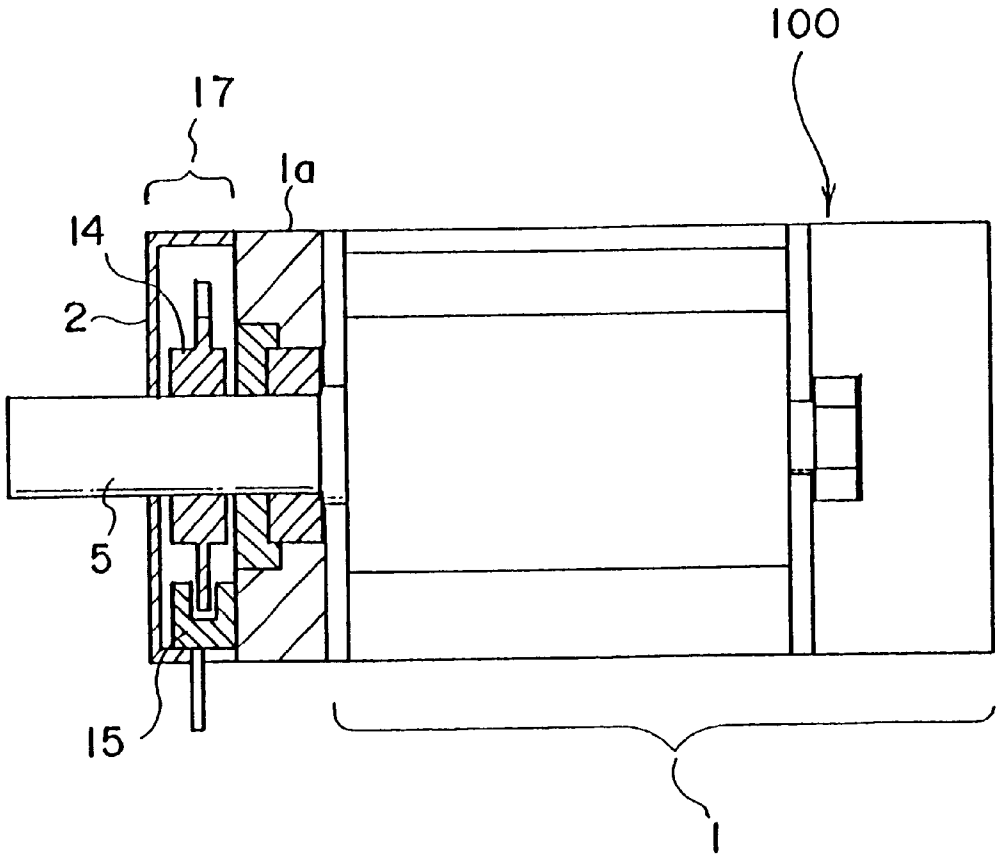
FIG. 5 and FIG. 6 are another embodiments of the fluid motor device used in the grinding apparatus according to the present invention, shown with local section.

FIG. 5 is another embodiment of the fluid motor device used in the grinding apparatus according to the present invention, shown with local section.

In the embodiment, the fluid motor device 100 is composed by assembling into the fluid motor 1 an optical rotary encoder 17 of incremental type, which includes an encoder disk 14, a photointerrupter 15, etc.

In FIG. 3, on the output shaft (rotating shaft) 5 extended from the fluid motor 1, is fitted an encoder disk 14 on the periphery, and to the housing 1*a* of the fluid motor 1, is joined the cover 12 of the optical rotary encoder 17 by means of bolts (not shown in the drawings).

Inside the cover 12, a two-phase output type photointerrupter is attached to the cover 12. The encoder disk 14 is fitted to the rotating shaft 5 of the fluid motor 1 so that the peripheral part of the encoder disk 14 interrupts the optical path of the photointerrupter 15. On the peripheral part that cross the optical path of the photointerrupter 14, are prepared slits (not shown in the drawings) at constant spacing. As the output shaft 5 rotates, the optical path of the photointerrupter 15 is blocked and cleared at regular intervals.

With the rotary encoder 17 as described above assembled to the output shaft 5 side of the fluid motor 1, pulses proportional in its number to the rotational speed of the fluid motor 1 and pulses for detecting the direction of rotation having definite phase difference from the aforementioned pulses, are outputted from the photointerrupter 15, in the operation of the fluid motor device 100. By counting the number of the pulses per unit time, the rotational speed of the fluid motor 1 is determined.

Therefore, according to the second embodiment, as the optical rotary encoder 17 is assembled to the output shaft 5 side, the fluid motor device 100, which is a integral unit of the fluid motor 1 and the optical rotary encoder 17, can be designed smaller in size. So, spatial limitation when the fluid motor is mounted is eliminated, and design freedom of the fluid motor device 100 is increased.

In the first embodiment, measurement of only rotational speed is possible, but in the second embodiment, also rotation angle of the fluid motor 1 is possible to be detected by cumulating the output pulses, which can be utilized for controlling positioning of the grinding wheel.

Figure 6:
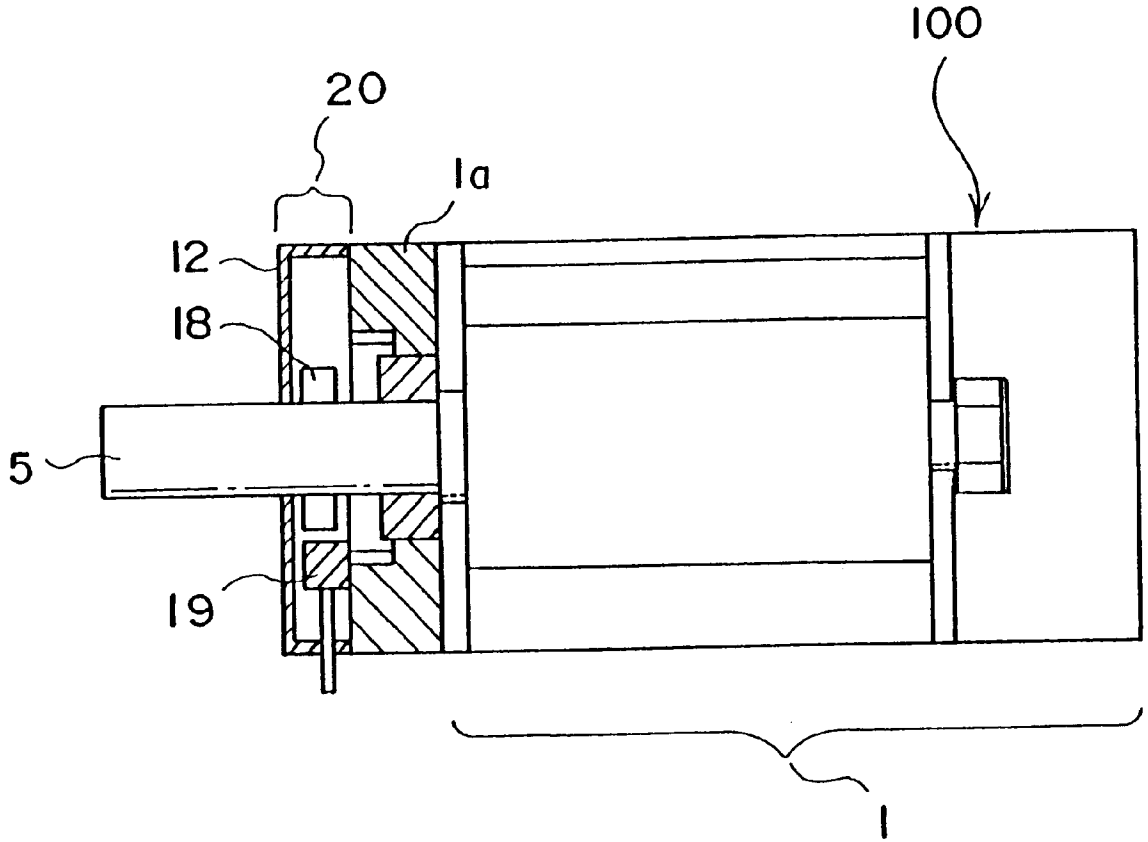
Figure 7:
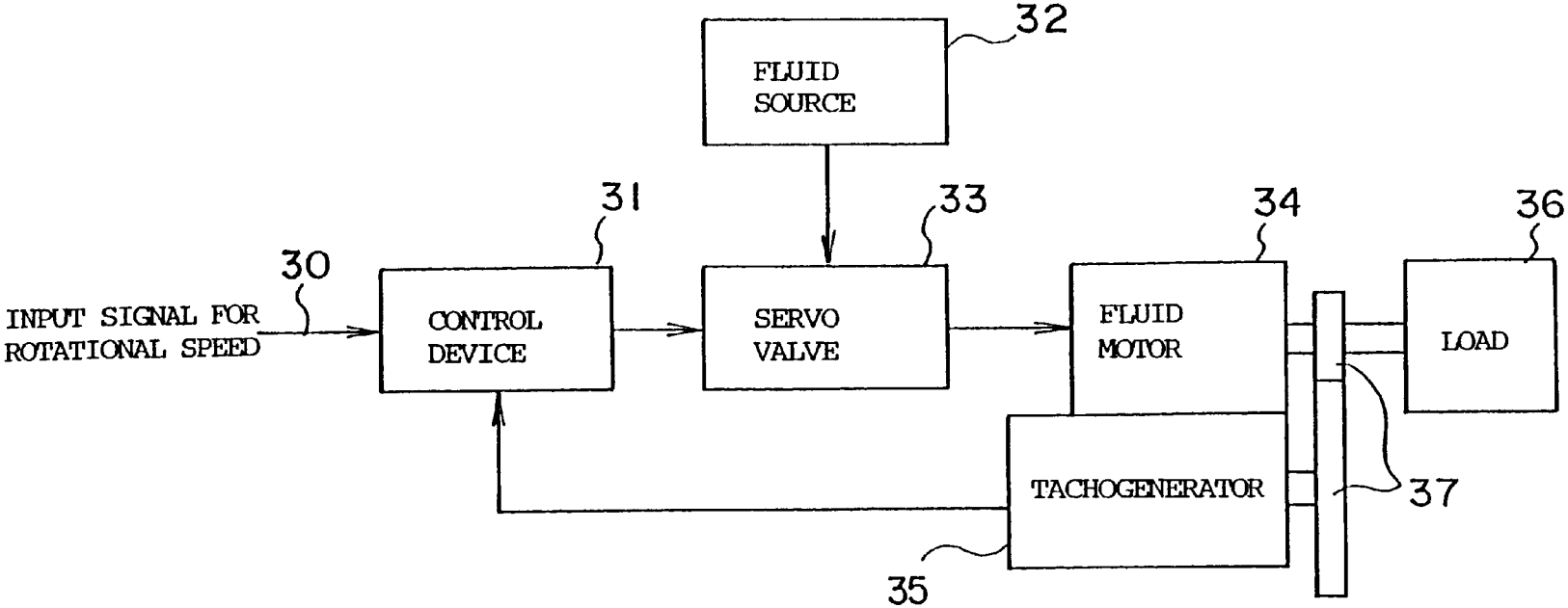
FIG. 7 is a block diagram showing a fluid motor device of prior art.

FIG. 6 is the third embodiment of the fluid motor device used in the grinding apparatus according to the present invention. shown in partial section. In this embodiment, fluid motor device 100 is composed so that, a ring-shaped magnetic body 18 polarized in the circumferential direction in an arbitrary number of poles, is fixed to the output shaft 5 of the fluid motor 1, and a hall IC 19 is provided adjacent to the periphery of the magnetic body 18, to compose a magnetic rotary encoder 20 for detecting the rotational speed of the fluid motor 1.

In FIG. 6, the magnetic body 18 polarized in the circumferential direction in an arbitrary number of poles is fitted to the output shaft 5 extended from the fluid motor 1, and the cover 12 of the rotary encoder 20 is joined to the housing 1*a* of the fluid motor 1 with bolts (not shown in the drawings). The hall IC 19 is attached, facing the magnetic body 18, to the cover 12 so as to be able to detect the pole of the magnetic body 18.

In the operation of the fluid motor device 100 constructed as described above, pulses proportional to the rotational speed of the fluid motor 1 are outputted from the hall IC 19. By counting the number of the pulses, rotational speed of the fluid motor 1 is determined.

Thus, according to the embodiment, the magnetic rotary encoder 20 is assembled directly to the output shaft 5 side of the fluid motor 1.

In the second or third embodiment, the incremental type rotary encoder 17 or the magnetic rotary encoder 20 may be attached to the supporting end side (the right side in FIGS. 5, 6) of the fluid motor 1.

What is claimed is:

1. A grinding apparatus comprising a grinding wheel attached to an output shaft of a fluid servomotor driven by fluid from a fluid source and controlled through a servo valve, wherein a housing of the servomotor is mounted on a stage moveable toward the work to be ground to press the grinding wheel against the work;

the output shaft of the servomotor extends through a cover attached to an output side of the fluid motor along a center line of the cover;

a rotation detector is provided comprising a rotating member mounted on the output shaft inside the cover and a rotation detecting member attached inside the cover facing the rotating member;

any difference between the rotational speed of the output shaft detected by the detector and a target rotational speed is determined by a control device;

the stage is moved in response to a control signal output from the control device, and in order to increase the grinding efficiency of the grinding wheel attached to the output shaft, the target rotation speed is set at a speed range of maximum output and grinding is performed with increased pressing force of the grinding wheel against the work to be ground.

2. A grinding apparatus comprising a grinding wheel attached to an output shaft of a fluid servomotor driven by fluid from a fluid source and controlled through a servo valve, wherein a housing of the servomotor is mounted on a stage moveable toward the work to be ground to press the grinding wheel against the work;

the output shaft of the servomotor extends through a cover attached to an output side of the fluid motor along a center line of the cover;

a rotation detector is provided comprising a rotating member mounted on the output shaft inside the cover and a rotation detecting member attached inside the cover facing the rotating member;

any difference between the rotational speed of the output shaft detected by the detector and a target rotational speed is determined by a control device;

the stage is moved in response to a control signal output from the control device, and in order to prevent wear of the grinding wheel attached to the output shaft, the target rotation speed is set at the high speed range and grinding is performed with decreased pressing force of the grinding wheel against the work to be ground.

3. A grinding apparatus comprising a grinding wheel attached to an output shaft of a fluid servomotor driven by fluid from a fluid source and controlled through a servo valve, wherein a housing of the servomotor is mounted on a stage moveable toward the work to be ground to press the grinding wheel against the work;

the output shaft of the servomotor extends through a cover attached to an output side of the fluid motor along a center line of the cover;

a rotation detector is provided comprising a rotating member attached to the output shaft inside the cover and a rotation detecting member attached inside the cover facing the rotating member;

any difference between the rotational speed of the output shaft detected by the rotation detector and a target rotational speed is determined by a control device;

the stage is moved in response to a control signal output from the control device, and the rotating member attached to the output shaft inside the cover is a rotor of a tachogenerator and the rotation speed detecting member attached inside the cover is a magnetic body of the tachogenerator.

4. A grinding apparatus comprising a grinding wheel attached to an output shaft of a fluid servomotor driven by fluid from a fluid source and controlled through a servo valve, wherein a housing of the servomotor is mounted on a stage moveable toward the work to be ground to press the grinding wheel against the work;

the output shaft of the servomotor extends through a cover attached to an output side of the fluid motor along a center line of the cover;

a rotation detector is provided comprising a rotating member attached to the output shaft inside the cover and a rotation detecting member attached inside the cover facing the rotating member;

any difference between the rotational speed of the output shaft detected by the detector and a target rotational speed is determined by a control device;

the stage is moved in response to a control signal output from the control device, and the rotating member attached to the output shaft inside the cover is a disk plate of an optical rotary encoder and the rotation speed detecting member attached inside the cover is a photointerrupter of the optical rotary encoder.

5. A grinding apparatus comprising a grinding wheel attached to an output shaft of a fluid servomotor driven by fluid from a fluid source and controlled through a servo valve, wherein a housing of the servomotor is mounted on a stage moveable toward the work to be ground to press the grinding wheel against the work;

the output shaft of the servomotor extends through a cover attached to an output side of the fluid motor along a center line of the cover;

a rotation detector is provided comprising a rotating member attached to the output shaft inside the cover and a rotation detecting member attached inside the cover facing the rotating member;

any difference between the rotational speed of the output shaft detected by the detector and a target rotational speed is determined by a control device;

the stage is moved in response to a control signal output from the control device, and the rotating member attached to the output shaft inside the cover member is a magnetic ring of a magnetic rotary encoder and the rotation speed detecting member attached inside the cover is a hall IC of the magnetic rotary encoder.

* * * * *